US005217034A

United States Patent [19]

Yih et al.

[11] Patent Number: 5,217,034

[45] Date of Patent: Jun. 8, 1993

[54] TENT COMBINATION

[76] Inventors: Chang H. Yih; Chang C. Yen, both of No. 850, Fengshih Rd., Fengyuan, Taichung Hsien, Taiwan

[21] Appl. No.: 707,599

[22] Filed: May 30, 1991

[51] Int. Cl.[5] ..... E04H 15/04; E04H 15/16

[52] U.S. Cl. ..... 135/90; 135/95; 135/96; 5/613; 5/420; 5/414; 5/419

[58] Field of Search ..... 135/90, 95, 96; 5/613, 5/417, 420, 418, 414, 419

[56] References Cited

U.S. PATENT DOCUMENTS

| | | | |
|---|---|---|---|
| 36,685 | 10/1862 | Brecht | 135/95 |
| 950,394 | 2/1910 | Hohl | 135/95 |
| 1,039,509 | 9/1912 | Gail | 135/96 |
| 1,116,074 | 11/1914 | Jones | 135/95 |
| 1,198,773 | 9/1916 | Robinson | 135/95 |
| 1,260,845 | 3/1918 | Winder | 135/95 |
| 3,621,858 | 11/1971 | Steele | 135/90 |
| 4,198,997 | 4/1980 | Miller | 135/90 |
| 4,605,029 | 8/1986 | Russell | 135/95 |

FOREIGN PATENT DOCUMENTS

| | | | |
|---|---|---|---|
| 30559 | 10/1922 | Denmark | 135/95 |

*Primary Examiner*—Henry E. Raduazo
*Attorney, Agent, or Firm*—Bacon & Thomas

[57] ABSTRACT

A tent including a base having a zipper disposed along the side edges and one end of the base, and a cover having a zipper disposed along the side edges and one end of the cover and engageable with the zipper of the base, a flap formed in the other end of the cover, an ear formed between the cover and the flap and can be coupled to an object at high level so that the tent can be formed, and a net coupled to the flap for closing the entrance of the tent.

2 Claims, 4 Drawing Sheets

TENT COMBINATION

BACKGROUND OF THE INVENTION

1. Field of the Invention

The present invention relates to a tent, and more particularly to a tent combination.

2. Description of the Prior Art

Typical tent is useful as a tent only and can not be used as a sleeping bag or a raincoat. On the contrary, a typical sleeping bag or a raincoat can not be used as a tent.

The present invention has arisen to mitigate and/or obviate the afore-described disadvantages of the conventional tents and sleeping bags and raincoats.

SUMMARY OF THE INVENTION

The primary objective of the present invention is to provide a tent combination which is convertible to a tent or a sleeping bag or a raincoat.

In accordance with one aspect of the invention, there is provided a tent combination which includes a base having a zipper disposed along the side edges and one end of the base, and a cover having a zipper disposed along the side edges and one end of the cover and engageable with the zipper of the base, a flap formed in the other end of the cover, an ear formed between the cover and the flap and can be coupled to an object at high level so that a tent can be formed, and a net coupled to the flap for closing the entrance of the tent.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
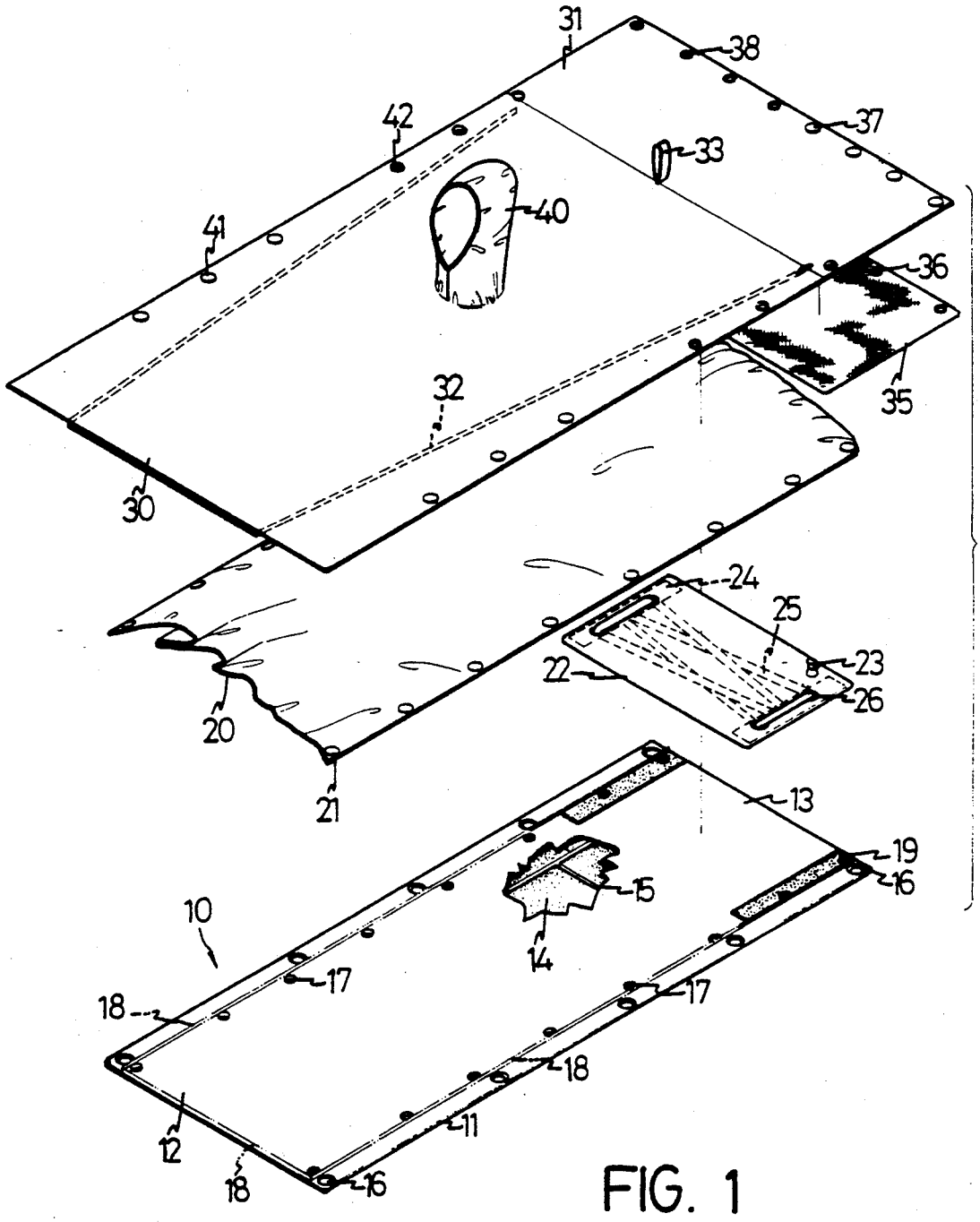
FIG. 1 is an exploded view of a tent combination in accordance with the present invention.
Figure 2:
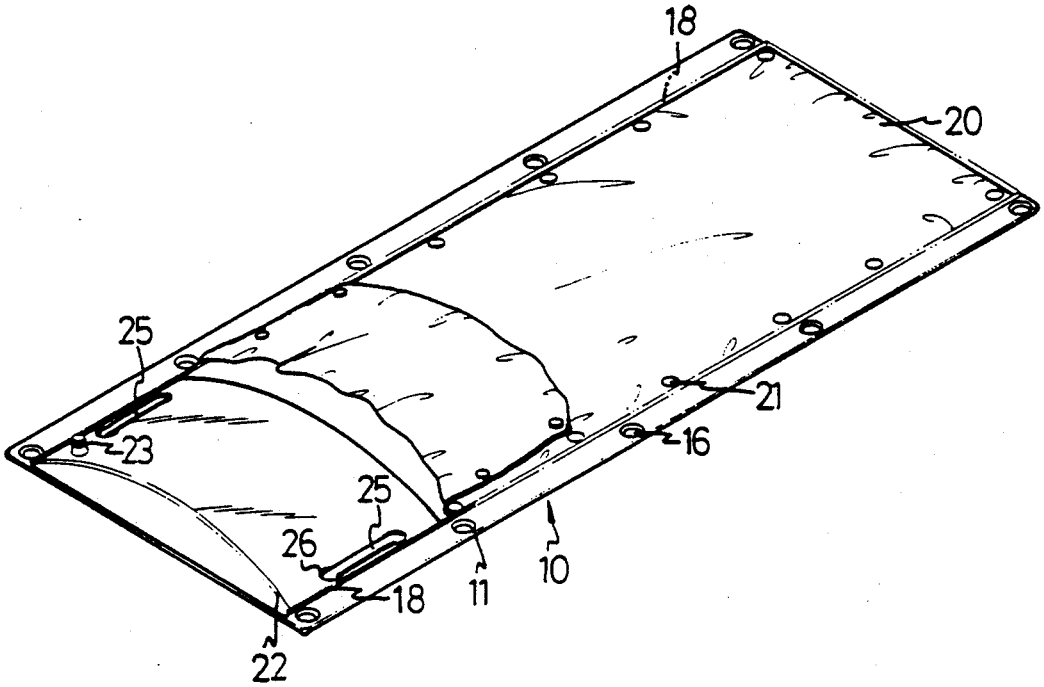
FIG. 2 is a perspective view of a sleeping bag.

Referring to the drawings and initially to FIGS. 1 and 2, a tent combination in accordance with the present invention comprises generally a base 10, a panel 20, an air pillow 22 and a cover 30. The base 10 includes two side edges 11, a first end 12 and a second end 13, and a plurality of cushions 14 embedded in the middle portion thereof. A gap 15 is formed between every two adjacent cushions 14 so that the base 10 can be easily folded. Each of the side edges 11 has a plurality of rings 16 and a plurality of female fasteners 17 provided therealong. Tent pegs (not shown) can be engaged in the rings 16 and can be fixed to the ground so that the base 10 can be stably fixed on the ground. An engaging means, such as a zipper 18 extends along the side edges 11 and the first end 12 of the base 10. A VELCRO type surface 19 is formed on each of the side edges 11 and close to the second end 13 of the base 10.

The panel 20 includes two side edges each having a plurality of male fasteners 21 provided therealong and engageable with the female fasteners 17 of the base 10 so that the panel 20 can be coupled to the base 10 and so that a sleeping bag as shown in FIG. 2 can be formed. The air pillow 22 includes an air tap 23 for supplying air into the air pillow 22 and a VELCRO type surface 24 formed on each side of the lower surface thereof and engageable with the VELCRO type surface 19 of the base 10 so that the air pillow 22 can be coupled to the base 10. Two strings 25 are strung through the rings 26 provided in the side edges of the air pillow 22 so that the air pillow 22 can also be used as a life buoy.

Figure 3:
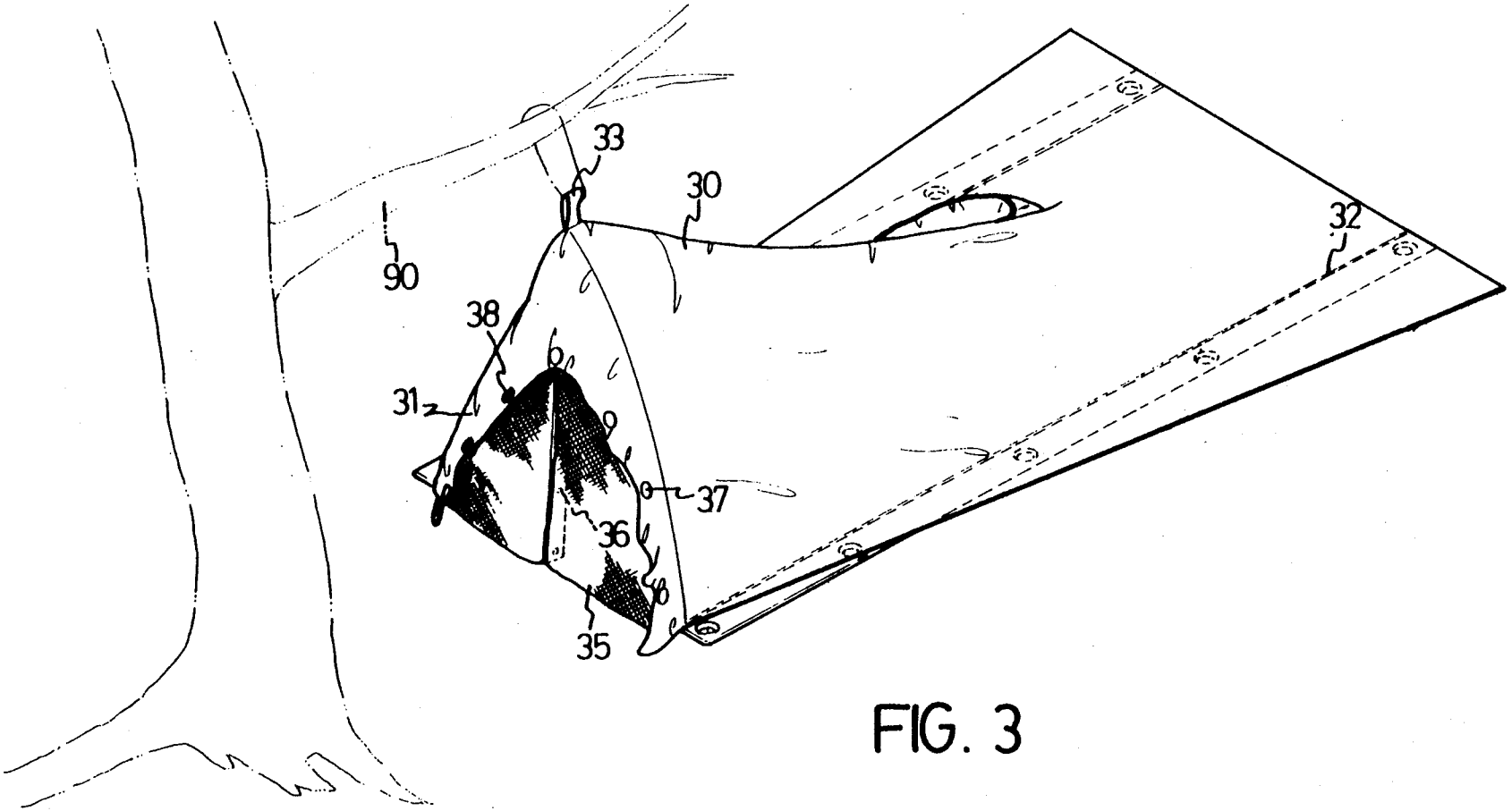
FIG. 3 is a perspective view of a tent.

Referring next to FIG. 3 and again to FIG. 1, the cover 30 includes an engaging means, such as a zipper 32 extended along two side edges and the first end portion thereof and engageable with the zipper 18 of the base so that three sides of the base 10 and the cover 30 can be coupled together, and a flap 31 formed on the second end portion thereof. An ear 33 is formed between the flap 31 and the cover 30 and can be coupled to an object, for example a branch of a tree 90, of higher level so that a tent is formed. An entrance of the tent is defined by the flap 31. A pair of mosquito nets 35 are provided to close the entrance of the tent and have an upper edge coupled to the flap 31, and have a middle portion engageable with each other by such as male and female fasteners 36 so that the nets 35 can be opened. A plurality of male fasteners 37 and female fasteners 38 are formed on the free end portion of the flap 31. The fasteners 36 of the nets 35 can be engaged with the respective fasteners 37, 38 so that the nets 35 can be maintained in an open position.

Figure 4:
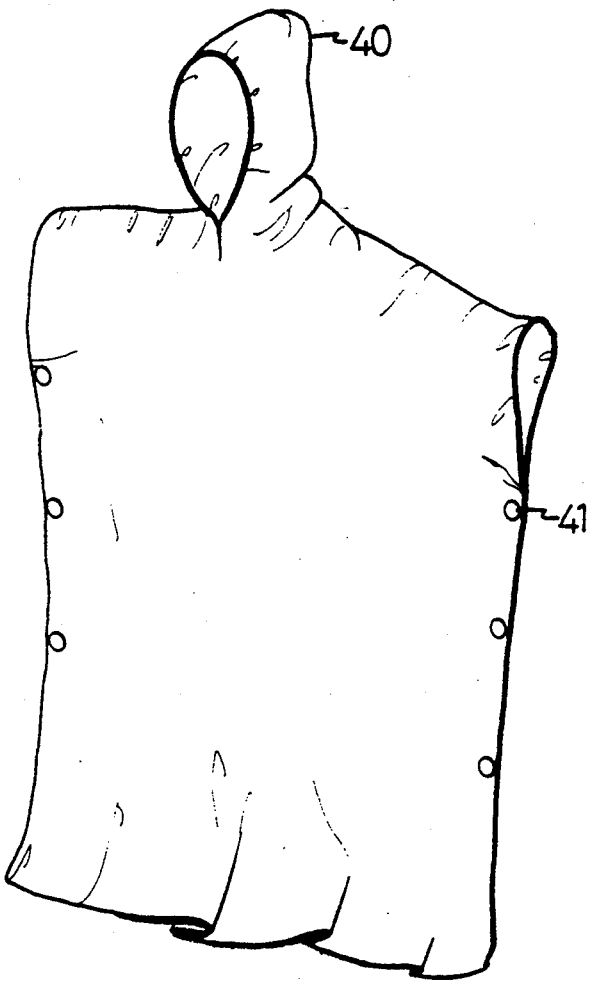
FIG. 4 is a perspective view of a raincoat.

Referring next to FIG. 4 and again to FIG. 1, a cap 40 is formed in the middle portion of the cover 30, and a plurality of male fasteners 41 and female fasteners 42 are engageable with one another so that a raincoat as shown in FIG. 4 can be formed.

Accordingly, the tent combination in accordance with the present invention is convertible to a tent, a sleeping bag and a raincoat.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tent combination comprising a base including two side edges and a first end and a second end, a first engaging means disposed along said side edges and said first end of said base, and a cover including two side edges and a first end and a second end, a second engaging means disposed along said side edges and said first end of said cover and engageable with said first engaging means of said base, a flap formed in said second end of said cover, an ear formed between said cover and said flap, said ear can be coupled to an object at high level so that a tent is formed, said tent having an entrance formed by said flap, and a net coupled to said flap for closing said entrance of said tent, a panel including two side edges, a plurality of first fasteners disposed along each of said side edges of said panel, and a plurality, of second fasteners disposed along each of said side edges of said base and engageable with said first fasteners of said panel so that said panel is coupled to said base and so that a sleeping bag is formed, an air pillow having, at least one first fastening surface formed on a lower surface thereof, at least one second fastening surface being formed on said second end of said base and engageable with said first fastening surface so that said air pillow is coupled to said base.

2. A tent combination according to claim 1, wherein a pair of strings are coupled to said air pillow so that said air pillow can be used as a life buoy.

* * * * *